US008674893B2

(12) United States Patent
Ecclestone

(10) Patent No.: US 8,674,893 B2
(45) Date of Patent: Mar. 18, 2014

(54) ANTENNA FEED ASSEMBLY

(75) Inventor: Timothy John Ecclestone, Stevenage (GB)

(73) Assignee: Astrium Limited, Hertfordshire (GB)

( * ) Notice: Subject to any disclaimer, the term of this patent is extended or adjusted under 35 U.S.C. 154(b) by 537 days.

(21) Appl. No.: 12/933,285

(22) PCT Filed: Feb. 27, 2009

(86) PCT No.: PCT/EP2009/052409

§ 371 (c)(1),
(2), (4) Date: Sep. 17, 2010

(87) PCT Pub. No.: WO2009/115407

PCT Pub. Date: Sep. 24, 2009

(65) Prior Publication Data

US 2011/0018758 A1 Jan. 27, 2011

(30) Foreign Application Priority Data

Mar. 18, 2008 (EP) ..... 08200009
Mar. 18, 2008 (GB) ..... 0804949.6

(51) Int. Cl.
*H01Q 19/195* (2006.01)

(52) U.S. Cl.
USPC ..... 343/756; 343/779; 343/753

(58) Field of Classification Search
USPC ..... 343/756, 779, 753
See application file for complete search history.

(56) References Cited

U.S. PATENT DOCUMENTS 4,090,203 A * 5/1978 Duncan ..... 343/753
4,375,878 A * 3/1983 Harvey et al. ..... 244/173.1
4,484,198 A 11/1984 Georgel
5,294,938 A * 3/1994 Matsuo et al. ..... 343/829
2004/0066344 A1* 4/2004 Amyotte et al. ..... 343/757
2005/0035920 A1* 2/2005 Bruchie ..... 343/840
2007/0018900 A1* 1/2007 Rao et al. ..... 343/779

FOREIGN PATENT DOCUMENTS

JP 6-104617 A 4/1994

OTHER PUBLICATIONS

Notification Concerning Transmittal of International Preliminary Report on Patentability (Forms PCT/IB/326 and PCT/IB/373) and the Written Opinion of the International Searching Authority (Forms PCT/ISA/237) issued in corresponding International Application No. PCT/EP2009/052409 dated Sep. 30, 2010.
International Search Report (PCT/ISA/210) for PCT/EP2009/052409 dated Apr. 22, 2009.

(Continued)

*Primary Examiner* — Jerome Jackson, Jr.
*Assistant Examiner* — Collin Dawkins
(74) *Attorney, Agent, or Firm* — Buchanan Ingersoll & Rooney PC

(57) ABSTRACT

An antenna feed assembly is provided which includes at least two elongate feed chains lying adjacent one another. Each feed chain is adapted to transmit or receive electromagnetic radiation between itself and the antenna along a longitudinal feed axis thereof via a transmit/receive element. The feed chains are held in fixed lateral relationship to one another by first and second mountings spaced apart axially of the feed chains. The transmit/receive elements extend axially from the first mounting towards the antenna and the second mounting is positioned on a side of the first mounting remote from the antenna. The first mounting has a lower coefficient of thermal expansion in the lateral direction than the second mounting whereby translational movement of each transmit/receive element in the lateral direction owing to temperature change of the assembly will be reduced.

15 Claims, 5 Drawing Sheets

(56) References Cited

OTHER PUBLICATIONS

Written Opinion (PCT/ISA/237) for PCT/EP2009/052409 dated Apr. 22, 2009.

United Kingdom Search Report for GB 0804949.6 dated Apr. 14, 2008.

European Search Report for EP 08200009 dated Jun. 12, 2008.

G. H. Schennum et al., "Antenna Subsystem for the INTELSAT VII spacecraft", 19900204-19900209, Feb. 4, 1990, pp. 83-92, XP010010338.

* cited by examiner

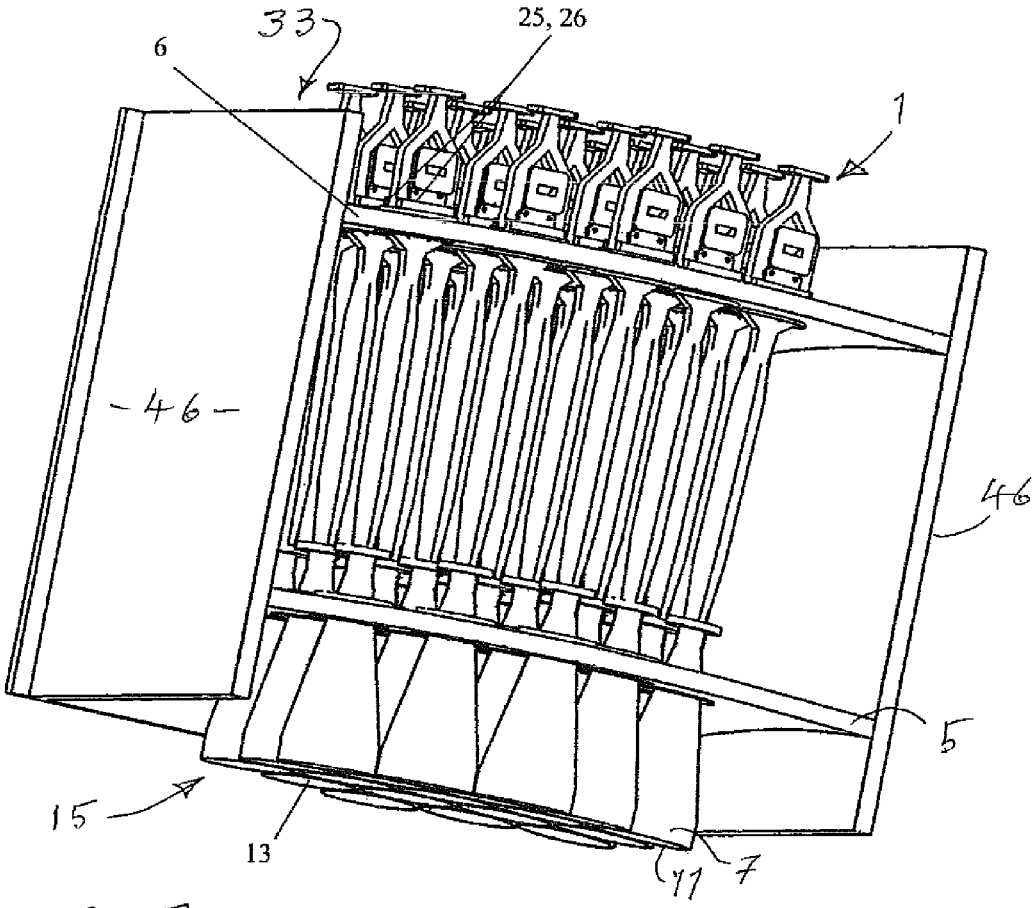
Fig. 7.
Fig. 8.
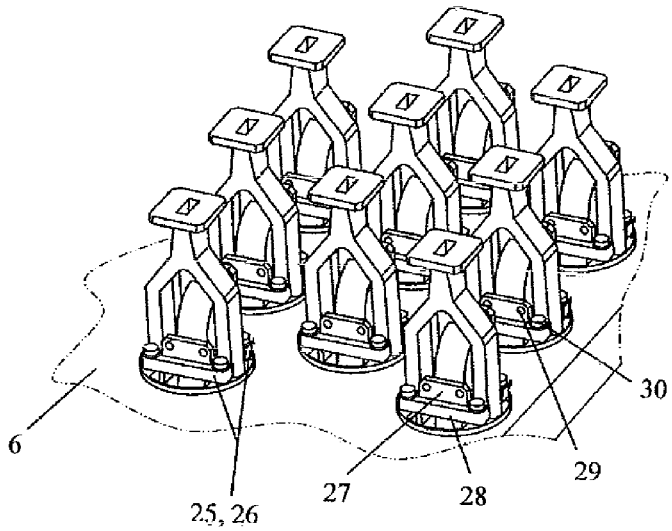

ANTENNA FEED ASSEMBLY

This invention relates to antenna feed assemblies, particularly but not exclusively to those used for satellite communications and in particular to beam pointing errors for an antenna caused by temperature fluctuations in the feed assembly.

For communications antennae on satellites it has long been a difficulty to avoid beam pointing errors for the antenna owing to temperature fluctuations of the satellite. These temperature fluctuations are caused in the main by the satellite moving into and out of the sun's radiation. A particular example of this occurring is that of geostationary satellites. These orbit the Earth and pass into and out of the sun's radiation as they do so. Such temperature changes are typically of the order of one hundred degrees Celsius and affect the whole satellite but in particular any external appendages on the satellite.

A communications satellite antenna is fed by electromagnetic radiation transmitted to the reflector from a focal plane of a feed comprised in a feed assembly. The feed assembly typically comprises an array of elongate feed chains arranged adjacent one another. Each will direct electromagnetic radiation, for example microwaves, at a different part of the antenna whereby the antenna will direct a corresponding beam of radiation at a predetermined area of the Earth's surface, for example to give television or mobile telephone coverage over a particular country. Each feed chain, which transmits/receives a dual polarised signal, usually comprises a conical feed horn at an end nearest the reflector leading into a wave polariser and then, at an end furthest from the reflector, an ortho mode transducer (OMT). The feed horns are typically arranged in an array of horns clustered closely together. This arrangement allows beams transmitted to the Earth from the antenna on the satellite to give substantially uninterrupted coverage of that part of the Earth's surface visible from the satellite. Alternatively, selected discrete areas of the Earth's surface may be targeted for coverage, eg, Portugal being selected for telecoms coverage but not Spain.

For geostationary satellites at a distance of approximately 35,000 kilometers from the Earth's surface, even a tiny change in the relative position of a feed horn with respect to the antenna can cause a significant movement of a beam pattern striking the Earth's surface from that feed horn. For example, a lateral movement of the feed horn owing to a temperature change in the feed horn assembly can cause a beam de-point of 0.01 degrees which can give a beam position movement on the Earths surface of 6 kilometers. Thus it will be appreciated that such feed assemblies can be extremely sensitive to positional changes owing to thermal expansion or contraction of mountings for the feed chains.

For reasons of weight saving the feed chains are often mounted in an aluminium alloy structure. However, this material has a relatively high coefficient of thermal expansion and lateral movement of the feed horns relative to one another when the assembly is subject to a large temperature change can become unacceptable owing to changes in beam coverage. With a single feed per beam (SFB) antenna in particular, a beam movement of 6 kilometers on the Earth's surface can make a significant difference, either to whether an area is covered by the signal at all, or whether the area receives a signal of sufficient strength. For example, it could move part of a large city, which was contracted for telecoms coverage, outside the beam coverage.

When low-distortion requirements apply to the satellite, the mounting for the feed chains may be made from low-distortion materials, for example, carbon fibre reinforced plastics (CFRP) or Invar. However these materials are expensive to use and, in the case of Invar, heavy, Invar having a specific gravity of 8.0. CFRP can be manufactured to form a very high strength/stiffness-to-mass ratio structure but it has poor thermal conductivity, making cooling of the feed assembly more difficult. Also, fabrication with bolted or other mechanical interfaces can be problematic for this material.

It is an object of the invention to provide a feed assembly for an antenna which overcomes some of the difficulties associated with the prior art.

According to a first aspect of the present invention there is provided an antenna feed assembly including at least two feed chains each having a longitudinal feed axis, the feed chains being disposed adjacent one another in a lateral direction, each feed chain being adapted to transmit or receive electromagnetic radiation between itself and a reflector of the antenna along the longitudinal feed axis thereof via a transmit/receive element, the feed chains being held in fixed relationship to one another by axially spaced first and second mountings, the feed chains extending axially from the second mounting past the first mounting towards the reflector with the transmit/receive elements being positioned between the first mounting and the reflector, the first mounting having a lower coefficient of thermal expansion in the lateral direction than the second mounting whereby to reduce translational movement of each transmit/receive element in the lateral direction caused by temperature change of the assembly.

It will be appreciated that if the assembly is subject to an increase or decrease in temperature, the first mounting will expand or contract, respectively, in a direction generally perpendicular to the feed axis of a feed chain by an amount proportional to its coefficient of thermal expansion. Similarly, the second mounting will expand or contract by a larger amount as it has a larger coefficient of thermal expansion. Because each feed chain is a rigid structure, any element of the feed chain projecting from the first mounting toward the antenna reflector will be caused to move, in the aforesaid generally perpendicular direction, by a lesser amount than any point on or between the first and second mountings, owing to the geometry of the arrangement. This geometry is as illustrated in FIGS. 1 and 2.

The transmit/receive elements are typically feed horns which are generally conical in shape, for microwave applications. The horns may be internally stepped or of a compound conical shape and may be internally profiled to optimise electrical performance. The portion of the element of which the lateral positioning is critical is normally an aperture defined by a rim of the feed horn. Alternatively, a phase centre for the feed horn, usually positioned a small amount axially inwardly from the rim of the feed horn, may be regarded as a critical part of the transmit/receive element. Thus the phrase "transmit/receive element" should be interpreted as that part of the transmit/receive element for which lateral positioning is considered to be critical.

The most desirable geometry for the feed assembly is where the critical part of the transmit/receive element is not deflected laterally at all with temperature change of the assembly. For this to occur the relationship between the coefficient of thermal expansion ($\alpha_1$) of the first mounting and the coefficient of thermal expansion ($\alpha_2$) of the second mounting is given by the equation:

$$\frac{\alpha_1}{\alpha_2} = \frac{a}{a+b}$$

where a is the axial distance from the transmit/receive element to the first mounting and b is the axial separation of the first and second mountings.

A mounting, and preferably both mountings, may include a panel disposed generally perpendicular to the feed axis of each feed chain, the panel defining apertures through which each feed chain extends.

It will be appreciated that, according to the invention, a panel forming the first mounting will comprise a coefficient of thermal expansion in the plane of the panel lower than a panel comprising the second mounting. Conveniently the first mounting may comprise titanium and the second mounting aluminium. The coefficient of thermal expansion of titanium is $8.5\times10^{-6}$ and that for aluminium is $23.0\times10^{-6}$. The ratio of these coefficients=0.370. Thus, a preferred embodiment of the invention, using a titanium panel for the first mounting and an aluminium panel for the second mounting and, in order to take advantage of this ratio, might define the axial distance from the transmit/receive element to the first mounting as being one unit and the axial separation of the first and second mountings as being two units.

Each feed chain will typically comprise a feed horn at an end thereof disposed nearest the antenna reflector in use and an OMT at a second end, the feed horn and the OMT being separated by a wave polarising element extending therebetween.

Where the first mounting comprises a said panel, the mounting may include a flange attachable to the feed chain, eg to a horn of the feed chain, and adapted to engage a wall defining a said aperture in the panel.

The flange preferably defines a close fit with the said wall of the aperture whereby accurately to locate the feed chain in the panel.

Where the second mounting comprises a said panel it may include a bracket connecting the feed chain to the panel with the bracket allowing limited tolerance in the relative positioning of the panel and feed chain.

Each bracket may include two orthogonal drilled members each to receive one or more fasteners therethrough to secure the feed chain to the mounting.

The assembly may comprise an array of feed chains having feed horns disposed closely adjacent one another. Any suitable number of feed chains is envisaged which can be grouped together in a manner which is economical with space.

The feed axes of the respective feed chains may extend parallel with one another towards the antenna or may intercept in the region of the antenna reflector.

According to a second aspect of the invention there is provided a communications antenna assembly, for example a microwave communications antenna assembly, including an antenna feed assembly according to the first aspect of the invention.

According to a third aspect of the invention there is provided a communications antenna assembly according to the second aspect of the invention which includes uplink and/or downlink, usually electronic, signal processing equipment for satellite communication with say Earth or another satellite.

According to a fourth aspect of the invention there is provided a communications satellite incorporating a communications antenna assembly according to the third aspect of the invention.

The invention will now be described by way of example with reference to the accompanying drawings of which:—

FIG. 7 is a three-dimensional view of a feed assembly showing feed horns mounted in a first panel and OMTs mounted in a second panel;

FIG. 8 is a three-dimensional view of OMTs mounted on a second panel;

Figure 1:
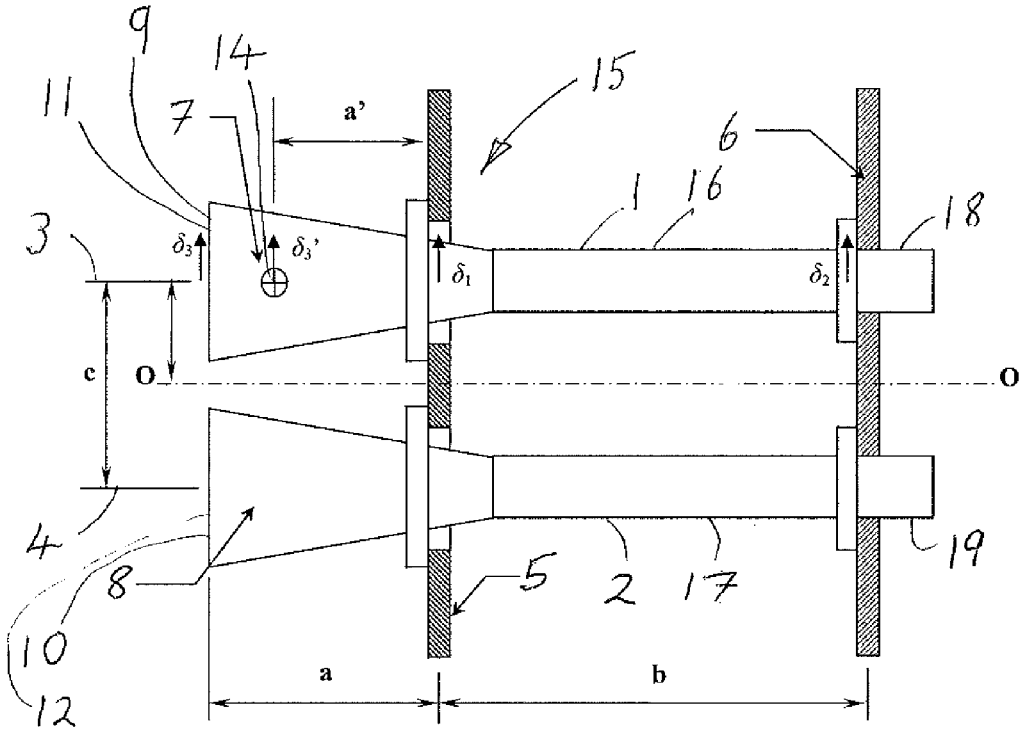
FIG. 1 is a diagrammatic side, partly sectional, view of a feed assembly comprising two feed chains and first and second panel mountings.

Referring to the drawings, the arrangement shown in FIG. 1 comprises a feed assembly 15. FIG. 1 shows adjacent feed chains 1, 2 each defining a longitudinal feed axis, 3, 4 mounted in a first mounting panel 5 and a second mounting panel 6. The feed chains each have a feed horn 7, 8 and an end 9, 10 of the feed chain nearest an antenna reflector (not shown). Each feed horn 7, 8 defines a rim 11, 12 facing the reflector. Each rim 11, 12 defines a feed aperture 13 (see FIG. 7) therein. Each feed horn 7, 8 also defines a phase centre 14. The feed horns 7, 8 may be used as transmit or receive elements for the assembly 15 depending upon whether the antenna is being used to transmit or receive at the time, and lateral positioning of either the feed aperture 13 or the phase centre 14 may be considered critical to the design of the assembly. It can be seen from FIG. 1 that the axial distance of the feed aperture 13 from the first mounting panel 5 is designated "a" and that for the phase centre is designated "a'". Each feed horn 7, 8 is connected to a polarising element 16, 17 which in turn is connected to an OMT 18, 19.

Figure 6:
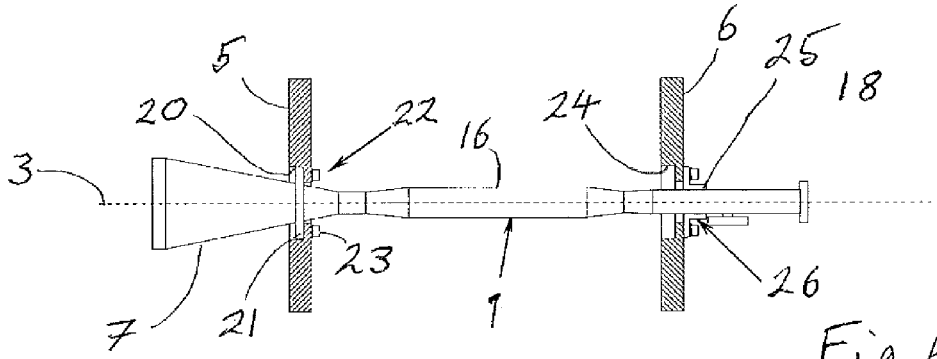
FIG. 6 is a side, partly sectional, view of a feed chain mounted in first and second panels showing detail of the mountings.

Details of mountings to the first and second panels 5, 6 are schematic in FIG. 1 and are shown in greater detail in FIGS. 6, 7 and 8. From FIG. 6 it can be seen that the first mounting panel 5 defines an elbowed aperture 20 therein. A flange 21 fixed to the feed horn 7 is a tight sliding fit into the elbow aperture 20 and is secured in position by bolts 22, 23 engaging the flange 21 through the panel 5. Thus the feed horn is precisely located longitudinally and laterally of the axis 3 by this arrangement.

Referring to FIGS. 6, 7 and 8 in particular, the mounting to the second mounting panel 6 is shown. Panel 6 similarly defines an elbowed aperture 24 (see FIG. 6). However, in order to allow for relative movement between the feed chain 1 and the panel 6 when bulk temperature change of the assembly 15 occurs, the mounting to the panel 6 is designed to be more flexible than the mounting to the panel 5. Brackets 25, 26 hold the OMT of the feed chain in position relative to the panel 6. These mountings are intended to afford the required limited flexibility. Each bracket 25, 26 comprises mutually perpendicular elements 27, 28, each defining bolt holes 29. Bolts, 30 secure the bracket 25, 26 to the panel 6 and OMT of the feed chain, respectively. It will be appreciated that static tolerances may be taken up by forming the boltholes slightly larger than the bolts and that dynamic tolerances, for example owing to temperature changes, may be taken up by flexibility designed into each bracket 25, 26.

It will also be appreciated that a more limited flexibility may be build into the mounting to the first panel 5 by careful selection of the material and thickness of the flange 21.

Figure 9:
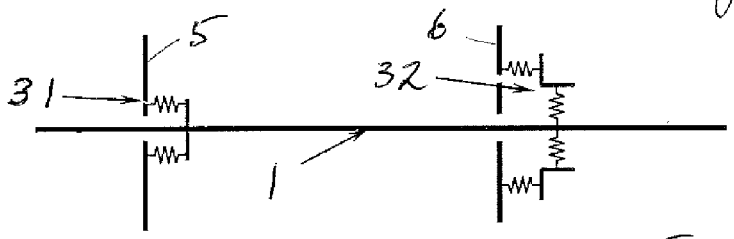
FIG. 9 shows diagrammatically required flexibility of feed chain mounting at first and second panels, respectively.
Figure 10:
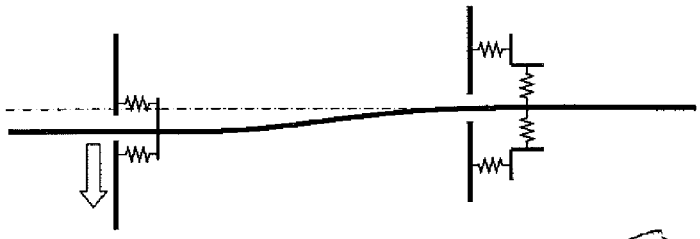
FIG. 10 shows diagrammatically a similar arrangement to FIG. 9 but with overly stiff panel mountings.
Figure 11:
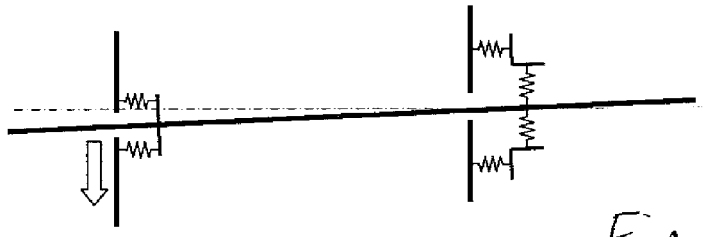
FIG. 11 shows diagrammatically a similar arrangement to FIG. 10 but with more flexible panel mountings.

FIGS. 9, 10 and 11 illustrate diagrammatically different stiffnesses of mounting arrangement of the feed chain. FIG. 9 illustrates the bolt/flange stiffness 31 at the mounting to the panel 5 and the bolt/cleat stiffness 32 at the mounting to the panel 6.

FIG. 10 illustrates what happens to the feed chain 1 when the panel 5 moves laterally downwardly relative to the panel 6 and where the stiffnesses 31, 32 are too great. It will be seen that the feed chain itself bends rather than flexing of the mountings occurring. FIG. 11 shows an arrangement with mountings of more appropriate stiffness which allow the feed chain to remain straight when the panels 5, 6 move laterally relative to each other.

Figure 12:
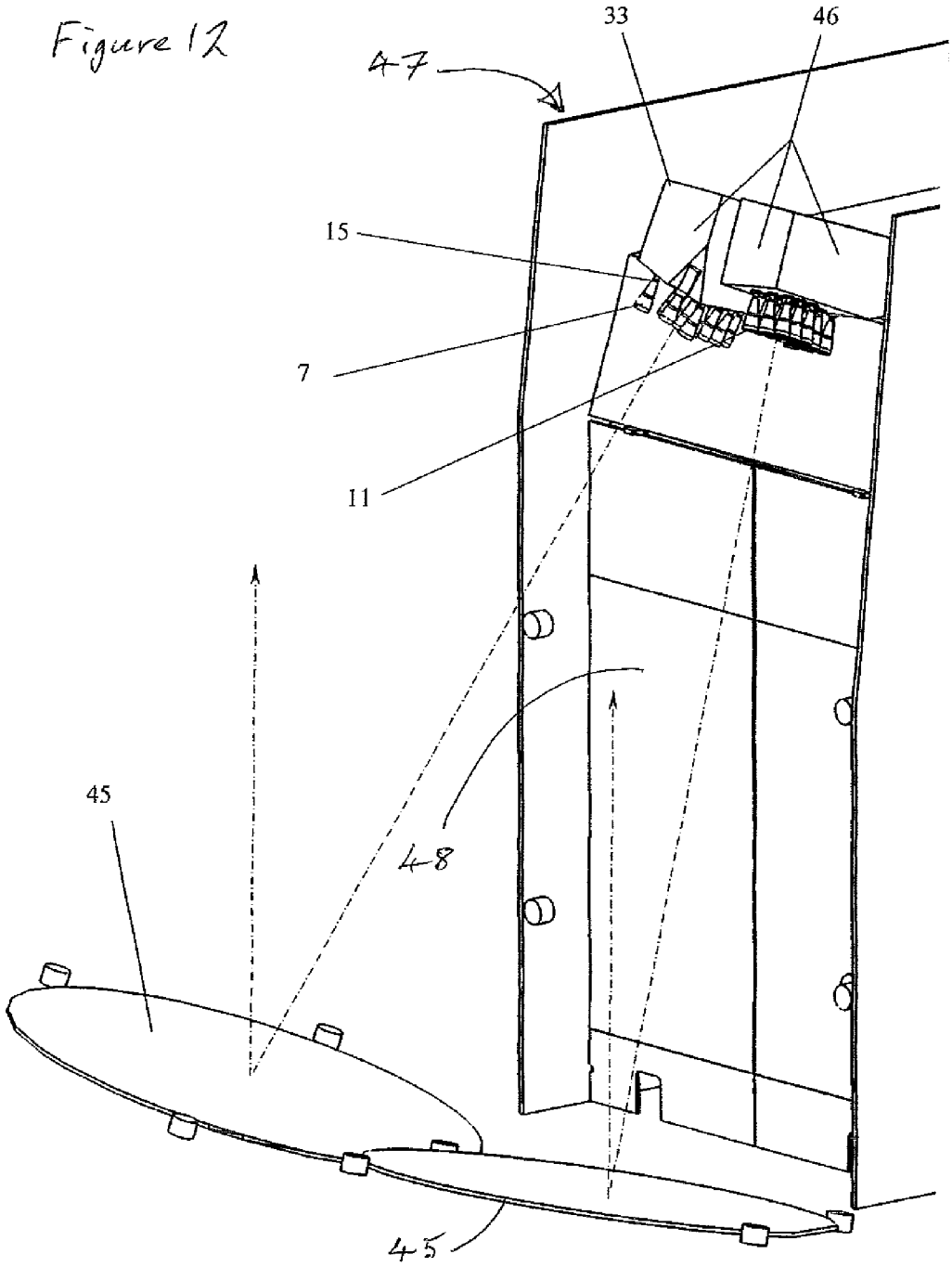
FIG. 12 is a three dimensional view of a communications satellite having two antenna assemblies.

Referring to FIGS. 7 and 12, FIG. 12 shows a communications satellite 47 having two feed assemblies 15 of the single feed per beam type, each directing radiation toward one of two antenna reflectors 45. Mountings for the antenna reflectors 45 are not shown but, as is conventional, these are designed to permit the reflectors to be moved between a stowed position (not shown) in a stowage bay 48 of the satellite and the deployed position shown in FIG. 12. FIG. 7 shows a single feed assembly in greater detail having an array of 19 feed chains 1 and also radiating surfaces 46 of a mounting box 33 of the feed assembly. The array of 19 feed chains 1 is shown having feed horns 7 mounted closely adjacent one another with rims 11 almost touching, for continuity of beam coverage combined with the use of minimum space on the satellite. It will be observed, upon close inspection, that feed axes of the feed chains are not parallel with each other but coincide at or near the antenna reflector surface (see FIG. 12). The array of feed chains 1 is mounted to first and second panels 5, 6 contained in the mounting box 33.

It will be appreciated that, because the feed chains emit a considerable amount of heat when transmitting radiation to or from the reflector, the panels 5, 6 are required to act as heat sinks and to conduct heat away from the feed assembly 15 to be radiated away by the radiating surfaces 46 of the mounting box 33.

Figure 3:
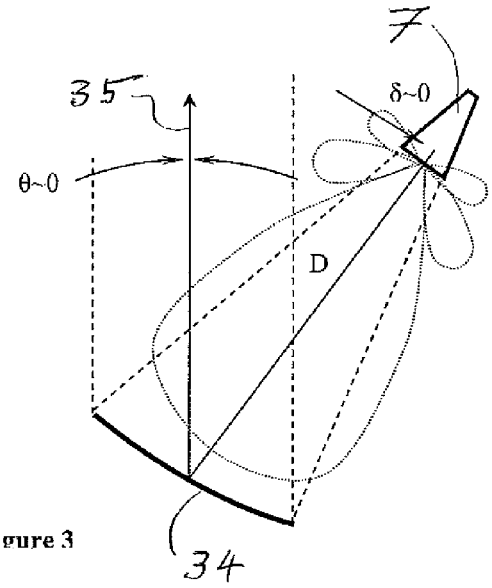
FIG. 3 illustrates diagrammatically the radiation pattern from a feed chain incident upon an antenna reflector giving a perfect boresight.
Figure 4:
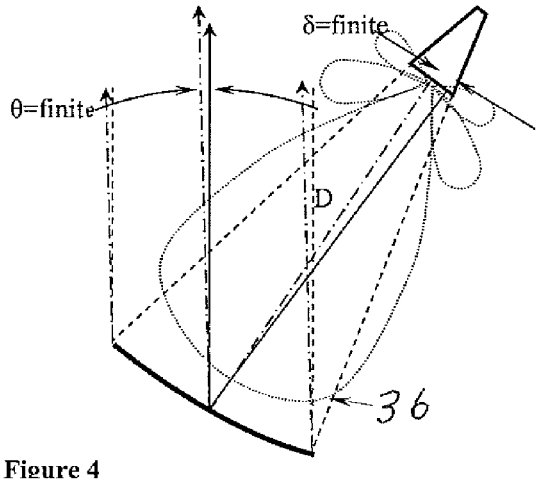
FIG. 4 shows a similar arrangement to FIG. 3 but with the feed chain being laterally displaced and causing an antenna boresight error.
Figure 5:
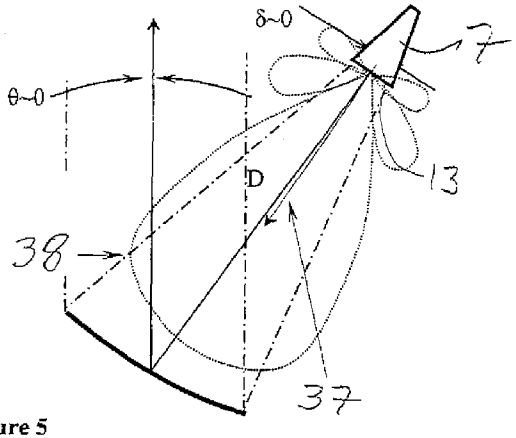
FIG. 5 shows a similar arrangement to FIG. 4 in which a feed axis of the feed chain is tilted but not laterally displaced.

The effect of different types of movement of the feed horns 7 relative to the antenna 34 is shown in FIGS. 3, 4 and 5. FIG. 3 shows a perfect electrical scenario. A feed horn 7 directs radiation along a feed axis D to an antenna 34 whence it is reflected along an antenna boresight 35. No lateral movement of the feed horn relative to the desired feed axis D has taken place. There is thus zero distortion and antenna gain is maintained together with antenna pointing. In theory this can be achieved with mounting panels of a multi feed assembly manufactured from a near-zero coefficient of thermal expansion material, for example, Invar or carbon fibre reinforced plastics. However, such materials can be expensive and problematic in both manufacture and thermal design (they have low thermal conductivity and do not always conduct heat away from the feed chains as efficiently as required). In the case of Invar there is also a significant mass penalty owing to its high specific gravity.

FIG. 4 shows a similar arrangement to that of FIG. 3 but with the feed chains of the feed assembly being mounted in a single mounting of light aluminium alloy construction as conventionally used for such feed assemblies. Due to bulk temperature effects there will always be some feed chain lateral displacement relative to the other feed chains in the assembly. This lateral displacement is illustrated in FIG. 4 by $\delta$ being of finite size. This affects pointing of the antenna adversely, for example, 0.01° pointing error may occur. This can decrease beam-to-beam isolation and/or reduce coverage over a specified area of the Earth's surface. A finite antenna boresight error $\theta$ is also illustrated in FIG. 4. The arrangement shown will give a slightly lower antenna gain at an edge 36 of the coverage owing to the feed horn boresight lateral translation.

FIG. 5 illustrates the case where there is no lateral deflection of the feed horn 7, only a slight tilt 37 of the feed axis D. This arrangement, according to the invention, maintains the lateral position of the aperture 13 of the feed horn 7 relative to the feed horn boresight axis D. There is however a slight feed horn pointing error owing to the horn boresight being tilted off line. This will result in slightly lower antenna gain at an edge 38 of coverage due to the horn boresight tilting. It will be noted however that the antenna boresight is maintained unaffected with $\theta$ equaling zero degrees. The horn boresight pointing error, which may be of the error of 0.1 degrees resulting in the slightly lower gain referred to above, will in fact be a very small effect.

Figure 2:
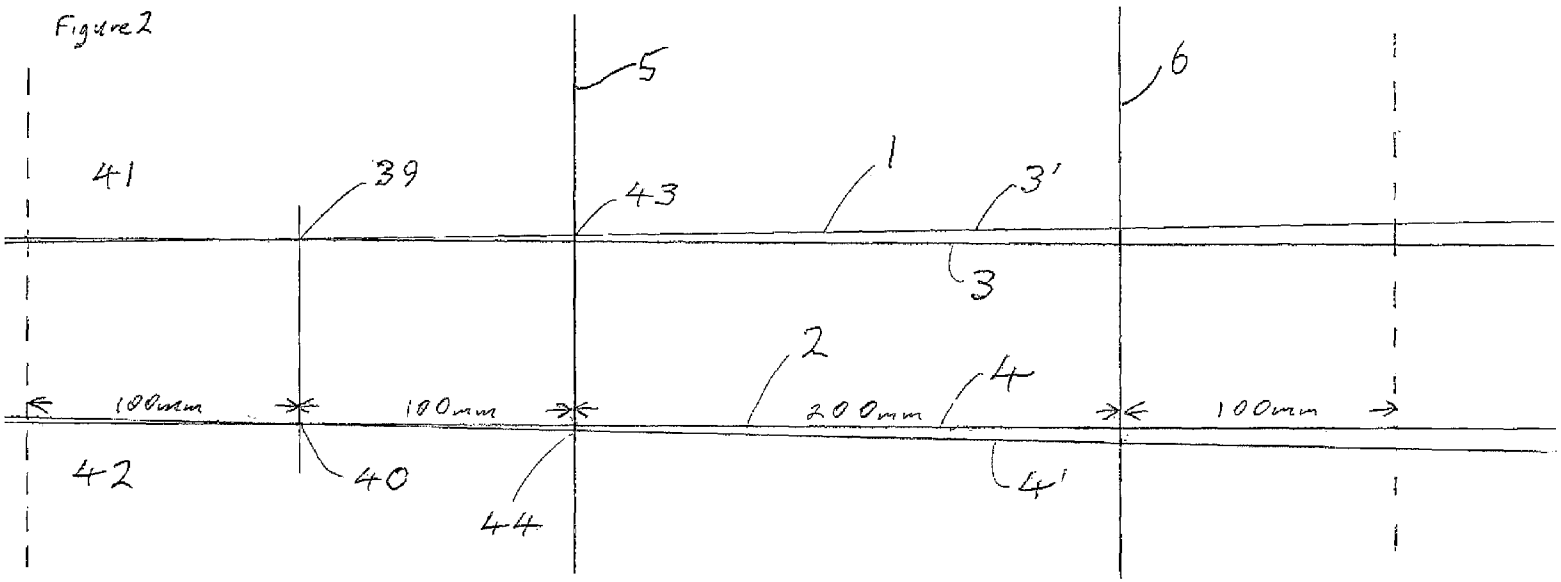
FIG. 2 shows a geometric arrangement according to the invention.

The geometry of the assembly according to the invention is shown in FIG. 2. Here the feed chains 1, 2 are shown mounted in a titanium first mounting panel 5 and an aluminium alloy second mounting panel 6. The feed axes 3, 4 are shown together with distorted feed axes 3', 4'. Centres 39, 40 of feed horn apertures 13 are shown. These undergo zero distortion when a bulk temperature change for the assembly causes expansion of the mounting panels 5 and 6 in a direction lateral to the feed axes 3, 4. The titanium panel 5 is shown expanding approximately one third as much as the aluminium alloy panel 6. With distance "a" being 100 mm and panel separation "b" being 200 mm this results in zero, or near zero, lateral distortion at positions 39 and 40. It will be appreciated that if the feed chains 1, 2 extend beyond positions 39, 40 then the lateral distortion will again increase from the zero, or near zero, distortion experienced at 39 and 40. Thus positions 41, 42, a further 100 mm distance from panel 5, will experience the same lateral distortion that the feed axis experiences at panel 5 but the distortion will be of opposite sign. Thus, a critical part of the feed chain, such as the horn aperture or horn phase centre, positioned anywhere between positions 41, 42 and 43, 44 (where the feed axes pass through the panel 5), will experience less lateral distortion due to temperature change than experienced at either panel 5 or panel 6. Thus, compared with the prior art, the assembly of the invention provides reduced lateral distortion of critical points on transmit/receive elements of the feed chain, with careful design allowing lateral distortion to be reduced down to zero.

The mathematical relationship generally illustrated in FIG. 2 will now be outlined below with reference to FIG. 1 of the drawings.

Now, consider that:

Panel 1 is subject to a bulk temperature change $\Delta T_1$ (CTE=$\alpha_1$)

Panel 2 is subject to a bulk temperature change $\Delta T_2$ (CTE=$\alpha_2$)

Let movement of front fixing position (in panel 1) from reference line O-O=$\delta_1$ And movement of rear fixing position (in panel 1) from reference line O-O=$\delta_2$ Therefore, $$\delta_1=\Delta T_1\alpha_1 c$$

$$\delta_2=\Delta T_2\alpha_2 c$$

For movement of horn aperture (for phase centre movement, replace "a, δ3" with "a', δ3'"):

Slope of feed-chain relative to O-O datum $$\text{slope} \approx \frac{\delta_1-\delta_2}{b}$$

$$\therefore \text{slope} \cong \frac{\Delta T_1\alpha_1 c-\Delta T_2\alpha_2 c}{b}$$

For movement at horn aperture:

$$\delta_3=\Delta T_2\alpha_2 c+\left\{\frac{\Delta T_1\alpha_1 c-\Delta T_2\alpha_2 c}{b}\right\}\cdot(a+b)$$

$$\Rightarrow \delta_3=\frac{1}{b}\{\Delta T_1\alpha_1(ac+cb)-\Delta T_2\alpha_2 ac\}$$

For zero displacement, i.e. $\delta_3=0$:

$$\Delta T_1\alpha_1(ac+cb)=\Delta T_2\alpha_2 ac$$

For a uniform MFA temperature increase (temperature gradients across the assembly tend to be an order smaller than the daily temperature variation), assume $\Delta T_1=\Delta T_2$.

For zero $\delta_3$:

$$\frac{\alpha_1}{\alpha_2}=\frac{a}{a+b}$$

Consider assembly where:

b=200 mm a=100 mm

Then, for minimised distortion, $$\frac{\alpha_1}{\alpha_2}=\frac{100}{100+200}=0.33\dot{3}$$

Consider aluminium rear panel, titanium front panel;

$$\frac{\alpha_{titanium}}{\alpha_{aluminium}}=\frac{8.5\times10^{-6}}{23.0\times10^{-6}}=0.370$$

This is close to the optimum relationship for this geometry. The geometry could be optimised to best suit available materials. Alternatively, another material possible for the front panel is AlBeMet (Registered Trade Mark). This would give the following result.

$$\frac{\alpha_{AlBeMet}}{\alpha_{aluminium}}=\frac{13.9\times10^{-6}}{23.0\times10^{-6}}=0.604$$

This gives less of a benefit for thermo-elastic distortion but, depending on the application, will give significant mass savings and reduce thermal gradients within the feed support structure.

The invention claimed is:

1. An antenna feed assembly including:

at least two feed chains each having a longitudinal feed axis, the feed chains being disposed adjacent one another in a lateral direction, each feed chain being adapted to transmit or receive electromagnetic radiation between itself and a reflector of an antenna along the longitudinal feed axis thereof via a transmit/receive element, the feed chains being held in fixed relationship to one another by axially spaced first and second mountings, the feed chains extending axially from the second mounting past the first mounting towards the reflector with the transmit/receive elements being positioned between the first mounting and the reflector, the first mounting having a lower coefficient of thermal expansion in the lateral direction than the second mounting, whereby the difference in an amount of thermal expansion between the first mounting and second mounting reduces a translational movement of each transmit/receive element in the lateral direction caused by temperature change of the antenna feed assembly.

2. An assembly as in claim 1 where a relationship between the co-efficient of thermal expansion $\alpha_1$ of the first mounting and the coefficient of thermal expansion $\alpha_2$ of the second mounting is given by an equation:

$$\frac{\alpha_1}{\alpha_2}=\frac{a}{a+b}$$

where a is an axial distance from the transmit/receive element to the first mounting and b is an axial separation of the first and second mountings.

3. An assembly as in claim 1 in which each of the first and second mountings includes:

a panel disposed generally perpendicular to the feed axis of each feed chain, the panel defining apertures through which each feed chain extends.

4. An assembly as in claim 1 in which the first mounting comprises titanium and the second mounting comprises aluminium.

5. An assembly as in claim 1 in which each feed chain comprises a feed horn at an end thereof positioned nearest the reflector, in use, an OMT at a second end and a polarising element extending between the feed horn and the OMT.

6. An assembly as in claim 1 in which the second mounting comprises a panel and includes a bracket connecting the feed chain to the panel and wherein the bracket allows limited tolerance in relative positioning of the panel and feed chain.

7. An assembly as in claim 1 in which the feed axes intersect one another.

8. A communications antenna assembly including an antenna feed assembly according to claim 1.

9. An assembly as in claim 3 in which each mounting includes a flange attachable to the feed chain and adapted to engage an elbow aperture in the panel.

10. An assembly as in claim 4 in which a ratio of an axial distance from the transmit/receive element to the first mounting and an axial separation of the first and second mountings is 1:2.

11. An assembly as in claim 5 comprising:

an array of feed chains having feed horns thereof disposed closely adjacent one another.

12. An assembly as in claim 7 in which the feed axes intersect one another in a region of the antenna reflector.

13. A communications antenna assembly according to claim 8 including uplink/downlink electronics equipment for satellite communication with Earth.

14. A communications satellite incorporating a communications antenna assembly according to claim 8.

15. An assembly as in claim 9 in which the flange defines a close fit with the said elbow aperture whereby accurately to locate the feed chain in the panel.

* * * * *